United States Patent [19]

Sargent

[11] 3,948,749

[45] Apr. 6, 1976

[54] ALUMINUM POTLINE SHIELD

[75] Inventor: Arthur F. Sargent, Parma, Ohio

[73] Assignee: Copperloy Corporation, Cleveland, Ohio

[22] Filed: Apr. 2, 1975

[21] Appl. No.: 564,423

[52] U.S. Cl. ..... 204/279; 204/243 R; 220/213; 228/173; 228/182

[51] Int. Cl.[2] ..... C25C 7/00; F16B 5/08

[58] Field of Search ..... 204/279, 243 R, 243 M, 204/244, 245, 246, 247, 67; 220/213; 228/173, 182, 141

[56] References Cited

UNITED STATES PATENTS

| | | | |
|---|---|---|---|
| 3,673,074 | 6/1972 | Hirt et al. | 204/243 R |
| 3,714,002 | 1/1973 | Kibby | 204/67 |
| R27,383 | 5/1972 | Johnson | 204/67 |

*Primary Examiner*—G. L. Kaplan
*Attorney, Agent, or Firm*—Millen, Raptes & White

[57] ABSTRACT

A shield or door for openings in the sides of an aluminum reduction pot is constructed from extrusions rolled to a desired curvature and fitted together longitudinally with tongue and groove means. The upper end of the shield is provided with an insulated lip adapted to rest on a corresponding lip of the potline. The bottom of the shield comprises a longitudinal triangular extrusion adapted to rest in a longitudinal groove of the potline. The shield containing a grab handle is adapted to be easily placed or removed from the side openings of the potline and are adapted to prevent noxious gases from escaping from the openings.

10 Claims, 8 Drawing Figures

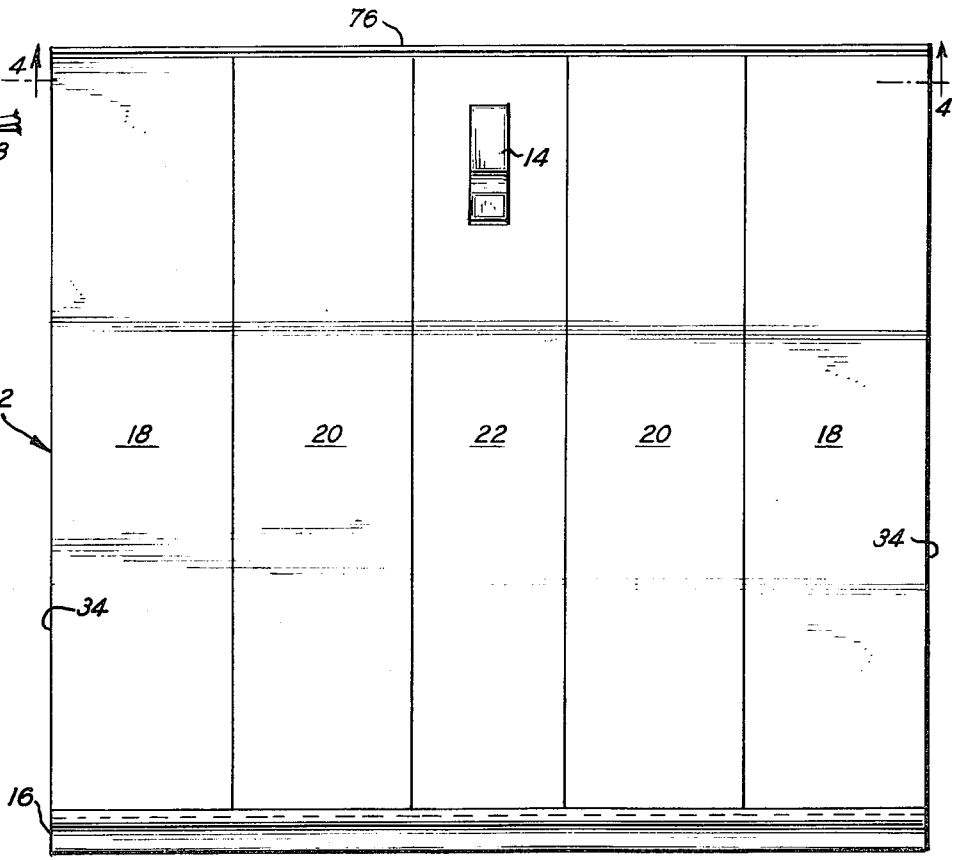
FIG. 2
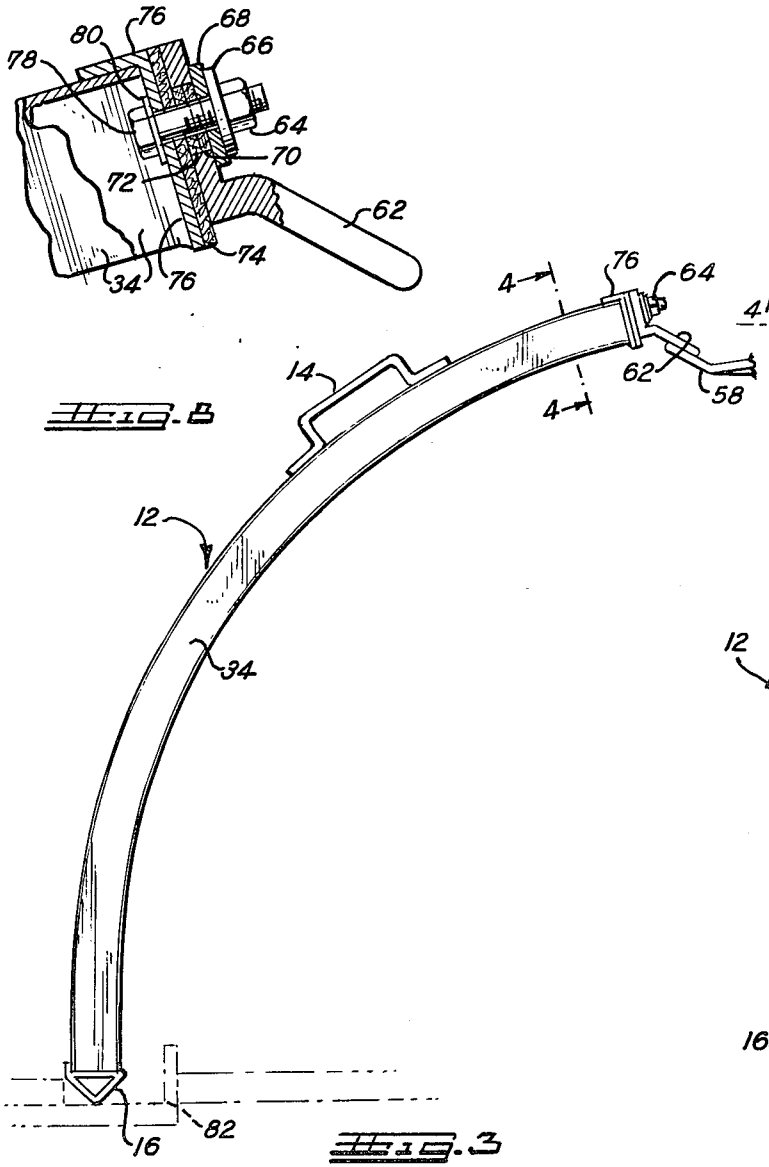
FIG. 3
FIG. 8

ALUMINUM POTLINE SHIELD

BACKGROUND OF THE INVENTION

The invention relates to a novel side shield or door for use with an aluminum reduction cell or potline. In the production of aluminum, a reduction cell, a series of which is called a potline, is used made of heavy steel plate in the form of a shallow box supported on an insulated floor. The cell is lined with carbon, and steel bars are embedded in the bottom carbon lining to conduct current into a layer of molten aluminum which acts as the cathode. The anode is made of carbon and is hung from above with a lower end extending into a molten bath containing cryolite a charge of alumina and calcium fluoride floating on the molten aluminum layer. With passage of direct current, the alumina decomposes and aluminum deposits on the cathode, oxygen on the carbon anode, and the anode is gradually consumed. During operation of the cell, the alumina is also gradually consumed and when it drops to certain levels a warning light comes on to alert the operator that more alumina is needed. Also during the operation of the cell, various gases are formed at the anode such as carbon dioxide and carbon monoxide. Also present in the cell is a metal fog of finely divided metallic sodium or aluminum.

Accordingly, it is necessary at various times for operators to work in the direct area of the aluminum reduction cell. Normally, the upper part of the potline is covered and has a curved metallic side structure. Removable shields or doors are disposed over rectangular openings in the sides of the potlines. Removal of the shield enables the operators to add alumina when necessary, to check the operation and any malfunctions of the cells, and to observe the consumption of the anode and its disposition in the molten layer. Conventional shields or doors, presently used, are constructed of metal sheets or plates which eventually warp due to the heat involved in the cells. The warped shields do not adequately cover the openings in the cells and the noxious gases escape to the atmosphere in the area of the cells, thus presenting hazards to operators.

BRIEF DESCRIPTION OF THE DRAWINGS

FIG. 2 is a front elevational view of the shield;

FIG. 3 is a side elevational view of the shield;

FIG. 8 is a partial view of the top portion of the shield, partly in section, disclosing details of the nose section.

DETAILED DESCRIPTION OF THE INVENTION

Figures 1, 4, 5, 6, 7:
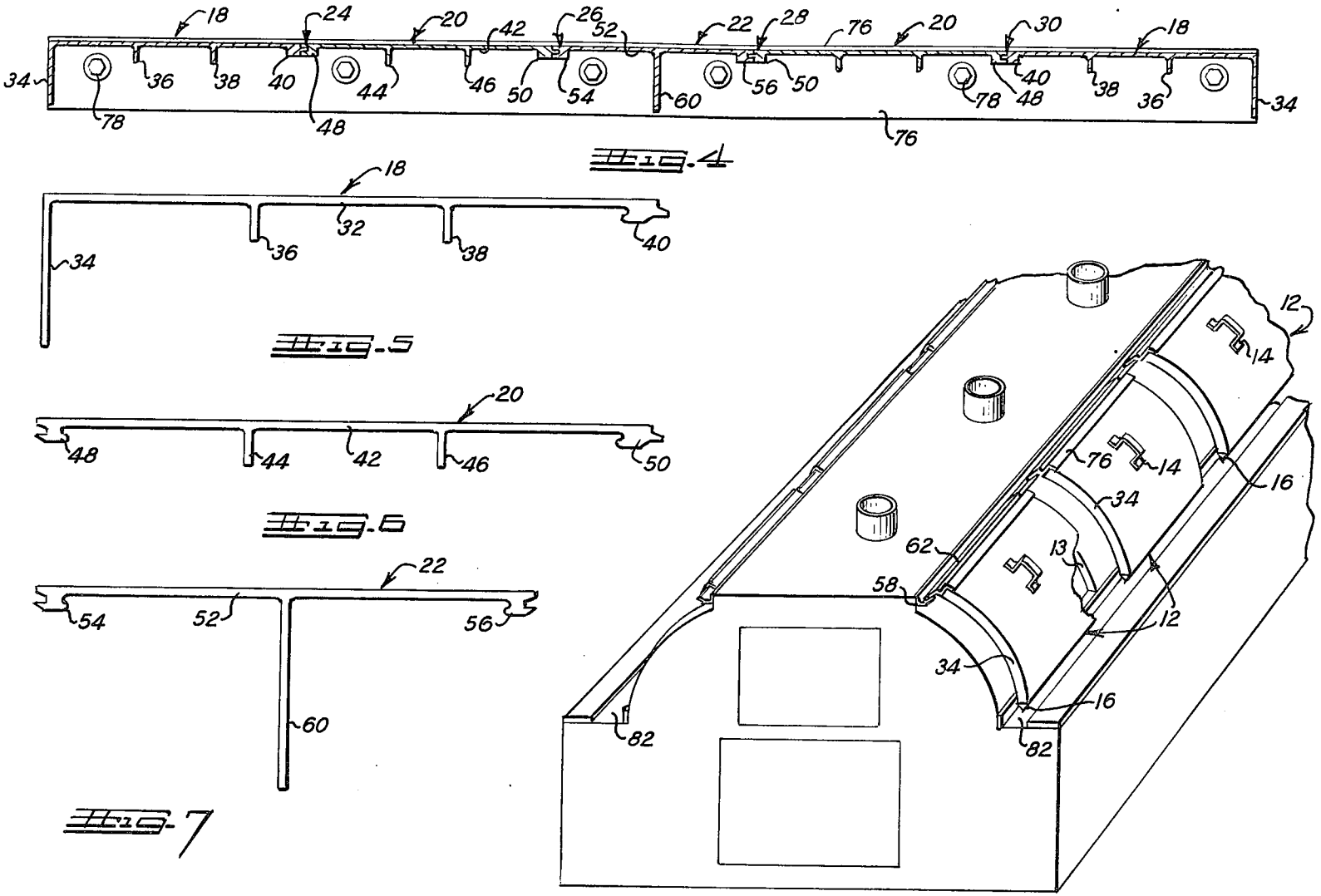
FIG. 1 is a partial perspective view of an electrolytic reduction potline used in the manufacture of aluminum disclosing the side shield of the invention.
FIG. 4 is a sectional view taken along line 4—4 of FIG. 3.
FIG. 5 is a side elevational view of one extrusion forming the end sections of the shield.
FIG. 6 is a side elevational view of a second extrusion forming the center section of the shield.
FIG. 7 is a side elevational view of a third extrusion forming an intermediate section of the shield.

Referring to the drawings, FIG. 1 shows a perspective view a conventional potline containing a series of aluminum reduction cells. On the curved sides of the potline there are disposed a plurality of removable shields or doors 12 which cover a plurality of curved rectangular openings 13 in the sides of the potline.

The shields 12 are the subject matter of this invention, are constructed of a metal such as aluminum and the like, and are adapted to be disposed over and cover the curved openings 13 of the potline. The shields have a lower end 16 resting in a groove 82 of the potline, and an insulated upper lip 62 resting on an upper horizontal lip 58 of the potline. A grab handle 14 on the shield enables an operator to remove or replace the shield.

Shield 12 has a generally curved shape as shown in FIG. 3 adapted to conform to the curved rectangular openings of the potline. The shield is constructed from three basic extrusions shown in FIGS. 5 through 7. Each extrusion is rolled initially to the desired curvature of the shield. The rolled extrusions are interlocked together by tongue and groove members forming a part of the extrusions and then are welded along the interlock joint.

Extrusion 18 is an end section and two are used to form both ends of the shield. Extrusion 20 is an intermediate section and two are used to form the shield. Extrusion 22 is a center section and one is used to form the center portion of the shield.

Extrusion 18 comprises a flat plate section 32, end section 34, stiffener ribs 36 and 38, and tongue interlock member 40 at the other end. Extrusion 20 comprises a flat plate section 42, stiffener ribs 44 and 46, groove interlock member 48 at one end, and tongue interlock member 50 at the other end. Extrusion 22 comprises flat plate section 52, a large stiffener rib 60 and groove interlock members 54 and 56 at each end.

The shield is assembled after each extrusion is rolled to the same desired curvature. Tongues 50 of two extrusions 20 are inserted into grooves 54 and 56 on each side of extrusion 22 to form interlocked joints 26 and 28 respectively (FIG. 4). Similarly, tongues 40 of two end extrusions 18 are inserted into grooves 48 of each extrusion 20 to form interlocked joints 24 an 30. The joints are welded on the underneath side to secure the joints.

A base or lower end extrusion 16, having a triangular shape, is assembled by welding to the bottom edge of the assembled curved extrusions of the shield. An extrusion 76 is welded to the upper ends of the assembled rolled extrusions. Lip 62 is an extrusion and is adapted to be connected to extrusion 76 by a plurality of threaded bolts 78, and washers 66 and 80, locknuts 64 through matching holes in both extrusions. Lip 62 is insulated from extrusion 76 by asbestos gasket 74 and asbestos washers 68, 70 and 72. The grab handle 14 is secured to the outer face of extrusion 22 by any suitable means.

The assembled shield 12 is a rugged unitary member not easily bent out of shape providing a long-lasting shield for the potline openings. The shield is easily and quickly disposed in place over the openings by placing end 16 in groove 82 and resting lip 62 on lip 58 of the potline. Curved sides 34 of the end extrusion 18 provide intimate contact with the curved sides of the potline, thereby preventing noxious gases from escaping from the potline.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A curved shield device for use in covering side openings in aluminum reduction potlines comprising a series of planar pre-rolled extrusion members longitudinally joined together, a base member disposed along the bottom edge of said extrusion member, and an insulated lip member disposed along the top edge of said extrusion members, whereby said bottom base member of said shield is adapted to be disposed in a longitudinal groove below said potline openings, and said lip member is adapted to overlap and rest on a longitudinal lip member disposed along the top of said potline openings.

2. The shield device of claim 1 wherein said extrusions include stiffener ribs.

3. The shield device of claim 1 wherein said extrusions are longitudinally joined together by tongue and groove means and welded there along.

4. The shield device of claim 1 wherein said base member is a triangular extrusion.

5. The shield of claim 1 wherein the end extrusions of said shield comprise curved, side, planar members.

6. The shield of claim 1 wherein an L-shaped extrusion is disposed along the top edge of said extrusion members, and said shield lip member is secured thereto with insulation disposed therebetween.

7. The shield of claim 1 wherein a grab handle is designed on its outer surface.

8. A method of constructing a curved shield device for use in covering openings in aluminum reduction potlines, comprising forming pairs of planar intermediate, pairs of planar end extrusions, and a planar center extrusion wherein each of said extrusions contain stiffener ribs on their inner surfaces, rolling each of said extrusions to a predetermined curvature, longitudinally joining said intermediate extrusions to respective sides of said center extrusion, joining said end extrusions to respective sides of said intermediate extrusions, securing a base member to the bottom edge of said joined extrusions, and securing an insulated lip member to the top edge of said joined extrusions.

9. The method of claim 8 wherein said extrusions are joined together by tongue and groove means and welded therealong.

10. The method of claim 8 wherein said lip member is secured to an L-shaped extrusion disposed along the top edge of said joined extrusions.

* * * * *